US009693443B2

(12) United States Patent
Eriksson et al.

(10) Patent No.: US 9,693,443 B2
(45) Date of Patent: Jun. 27, 2017

(54) SELF-SHIELDING TARGET FOR ISOTOPE PRODUCTION SYSTEMS

(75) Inventors: Tomas Eriksson, Uppsala (SE); Jonas Norling, Uppsala (SE)

(73) Assignee: General Electric Company, Schenectady, NY (US)

( * ) Notice: Subject to any disclaimer, the term of this patent is extended or adjusted under 35 U.S.C. 154(b) by 1337 days.

(21) Appl. No.: 12/763,049

(22) Filed: Apr. 19, 2010

(65) Prior Publication Data

US 2011/0255646 A1 Oct. 20, 2011

(51) Int. Cl.
*H05H 6/00* (2006.01)
*G21G 1/10* (2006.01)

(52) U.S. Cl.
CPC ..... *H05H 6/00* (2013.01); *G21G 1/10* (2013.01)

(58) Field of Classification Search
USPC ..... 376/156
See application file for complete search history.

(56) References Cited

U.S. PATENT DOCUMENTS

| | | | | |
|---|---|---|---|---|
| 3,852,610 | A | 12/1974 | McIntyre | |
| 5,015,863 | A * | 5/1991 | Takeshima et al. | 250/515.1 |
| 5,235,239 | A | 8/1993 | Jacob et al. | |
| 5,392,319 | A * | 2/1995 | Eggers | 376/194 |
| 5,917,874 | A | 6/1999 | Schlyer et al. | |
| 6,433,495 | B1 | 8/2002 | Wiberg | |
| 6,585,953 | B2 | 7/2003 | Roberts | |
| 6,954,515 | B2 | 10/2005 | Bjorkholm et al. | |
| 7,030,399 | B2 | 4/2006 | Williamson et al. | |
| 7,436,932 | B2 * | 10/2008 | Clayton | 378/143 |
| 7,888,891 | B2 | 2/2011 | Gehman | |
| 2004/0100214 | A1 * | 5/2004 | Erdman | 315/500 |
| 2005/0061994 | A1 | 3/2005 | Amini | |
| 2007/0137847 | A1 * | 6/2007 | Schedler et al. | 165/181 |
| 2008/0093567 | A1 | 4/2008 | Gall | |
| 2009/0041197 | A1 | 2/2009 | Clayton | |
| 2009/0052628 | A1 * | 2/2009 | Wilson et al. | 378/143 |
| 2009/0206270 | A1 | 8/2009 | Glayish et al. | |
| 2009/0206275 | A1 | 8/2009 | Henley et al. | |
| 2009/0261248 | A1 | 10/2009 | Glavish et al. | |

FOREIGN PATENT DOCUMENTS

| | | |
|---|---|---|
| EP | 1120025 A1 | 8/2001 |
| EP | 1315689 A1 | 6/2003 |
| EP | 2146555 A1 | 1/2010 |

(Continued)

OTHER PUBLICATIONS

Search Report and Written Opinion from corresponding PCT Application No. PCT/US2011/029499, Jun. 30, 2011.

(Continued)

*Primary Examiner* — Sean P Burke
(74) *Attorney, Agent, or Firm* — Dean D. Small; The Small Patent Law Group, LLC

(57) ABSTRACT

A self-shielding target for isotope production systems is provided. The target includes a body configured to encase a target material and having a passageway for a charged particle beam, and a component within the body, wherein the charged particle beam induces radioactivity in the component. Additionally, at least one portion of the body is formed from a material having a density value greater than a density value of aluminum to shield the component.

18 Claims, 6 Drawing Sheets

(56) References Cited

FOREIGN PATENT DOCUMENTS

| | | | |
|---|---|---|---|
| EP | 1736040 | B1 | 10/2013 |
| JP | 06222150 | A | 8/1994 |
| JP | 2000105300 | A | 4/2000 |
| JP | 2004508343 | A | 3/2004 |
| JP | 2004294300 | A | 10/2004 |
| JP | 2005285448 | A | 10/2005 |
| JP | 2006133138 | A | 5/2006 |
| JP | 2007047096 | A | 2/2007 |
| JP | 2007095553 | A | 4/2007 |
| WO | 0019787 | A1 | 4/2000 |
| WO | 0220434 | A1 | 3/2002 |
| WO | 2005094142 | A2 | 10/2005 |

OTHER PUBLICATIONS

Office Action dated Dec. 20, 2017 for copending Application No. JP 2015/245775, (7 pages).

* cited by examiner

SELF-SHIELDING TARGET FOR ISOTOPE PRODUCTION SYSTEMS

BACKGROUND OF THE INVENTION

The subject matter disclosed herein relates generally to isotope production systems, and more particularly to shielding of targets of the isotope production systems.

Radioisotopes (also called radionuclides) have several applications in medical therapy, imaging, and research, as well as other applications that are not medically related. Systems that produce radioisotopes typically include a particle accelerator, such as a cyclotron, that has a magnet yoke that surrounds an acceleration chamber. The acceleration chamber may include opposing pole tops that are spaced apart from each other. Electrical and magnetic fields may be generated within the acceleration chamber to accelerate and guide charged particles along a spiral-like orbit between the poles. To produce the radioisotopes, the cyclotron forms a beam of the charged particles and directs the particle beam out of the acceleration chamber and toward a target system having a target material (also referred to as a starting material). The particle beam is incident upon the target material thereby generating radioisotopes.

During operation of an isotope production system, large amounts of radiation (i.e., unhealthy levels of radiation for individuals nearby) are typically generated within the target system and, separately, within the cyclotron. For example, with respect to the target system, radiation from neutrons and gamma rays may be generated when the beam is incident upon the target material. With respect to the cyclotron, ions within the acceleration chamber may collide with gas particles therein and become neutral particles that are no longer affected by the electrical and magnetic fields within the acceleration chamber. These neutral particles, in turn, may also collide with the walls of the acceleration chamber and produce secondary gamma radiation.

Thus, during production of radio isotopes, such as for Positron Emission Tomography (PET) applications, the starting material (confined in the target system) is typically irradiated with high energy particles. Accordingly, the target system and the materials used to construct the target system are also exposed to the high energy particles and will thus also be highly radioactive. The high radioactive activation of the target system makes servicing and handling of the equipment generally very time and cost consuming, in particular, because of the need to wait for acceptable radiation levels to decrease, which may take at least 24 hours. Even after this time period, precautions are necessary when approaching the system because radiation exposure levels are strictly regulated by law. Thus, servicing of this kind of equipment is also difficult as service personnel may quickly reach maximal annual limits. Accordingly, in order to reduce dose load per person, a relatively high number of people may be required to share the dose to reasonable levels.

To protect nearby individuals from the radiation (e.g., employees or patients of a hospital), isotope production systems may use shields to attenuate or block the radiation. In conventional isotope production systems, shielding of the radiation (e.g., radiation leakage) has been addressed by adding a large amount of shielding that surrounds both the cyclotron and the target system. However, the large amounts of shielding may be costly and too heavy for the rooms where the isotope production system are to be located. Alternatively or in addition to the large amounts of shielding, isotope production systems may be located within a specially designed room or rooms. For example, the cyclotron and the target system may be in separate rooms or have large walls separating the two.

BRIEF DESCRIPTION OF THE INVENTION

In accordance with various embodiments, a target for an isotope production system is provided. The target includes a body configured to encase a target material and having a passageway for a charged particle beam, and a component within the body, wherein the charged particle beam induces radioactivity in the component. Additionally, at least one portion of the body is formed from a material having a density value greater than a density value of aluminum to shield the component.

In accordance with other various embodiments, an isotope production system is provided that includes an accelerator. The accelerator includes a magnet yoke and also has an acceleration chamber. The isotope production system further includes a target system located adjacent to or a distance from the acceleration chamber. The cyclotron is configured to direct a particle beam from the acceleration chamber to the target system. The target system is configured to hold a target material and is self-shielded to attenuate radiation from one or more activated parts within the target system, and further includes one or more housing portions encasing the target material, wherein at least one of the housing portions is aligned with the activated parts and is formed from a material having a density greater than aluminum.

In accordance with yet other embodiments, a method for producing a shielded target for an isotope production system includes forming one or more portions of a target housing from a material having a density value greater than 5 g/cm$^3$. The method further includes encasing radioactive activated components with at least one of the portions of the target housing.

DETAILED DESCRIPTION OF THE INVENTION

Figure 1:
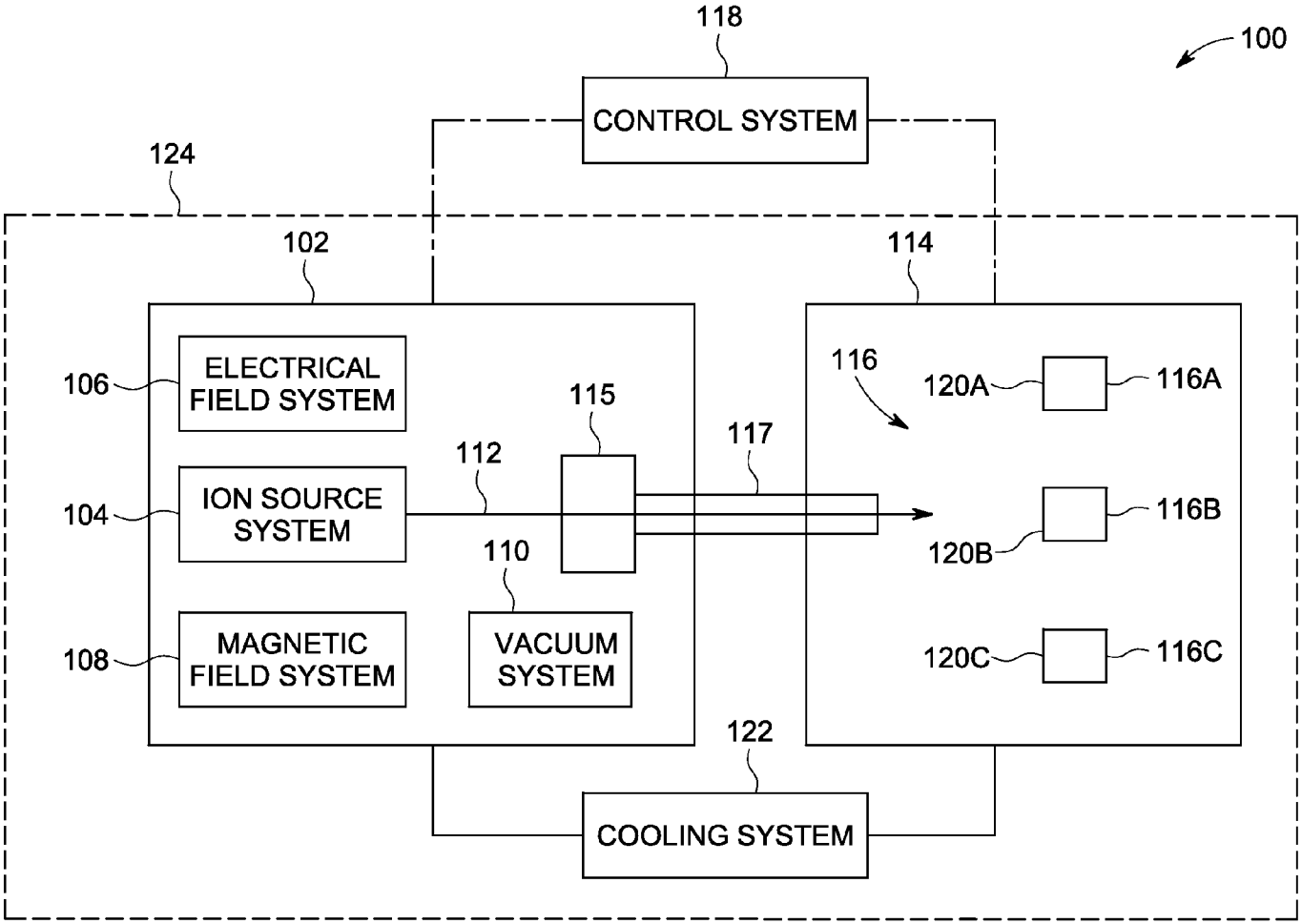
FIG. 1 is a block diagram of an isotope production system having a self-shielded target system formed in accordance with various embodiments.
Figure 2:
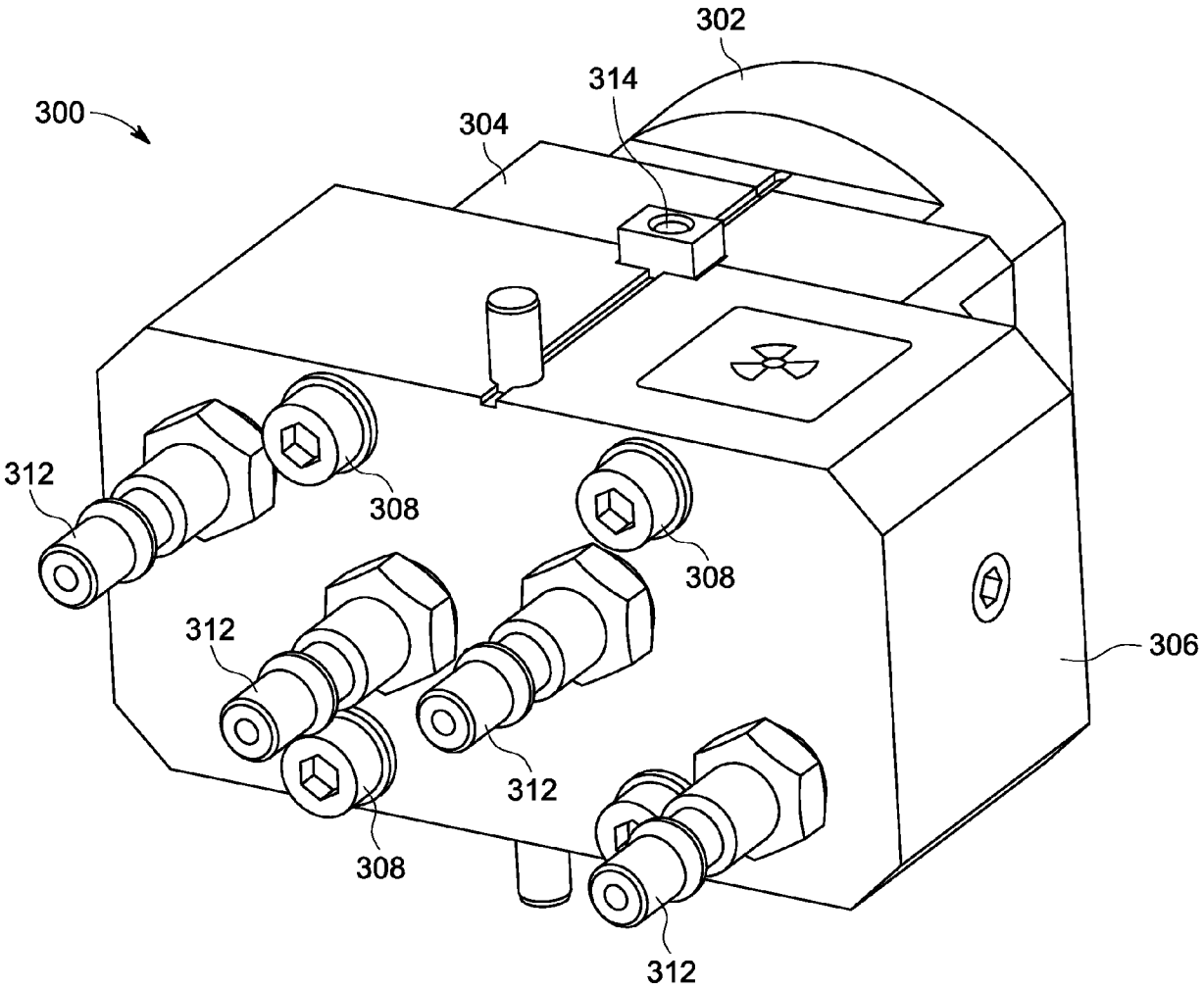
FIG. 2 is a perspective view of a target body for a target system formed in accordance with various embodiments.
Figure 3:
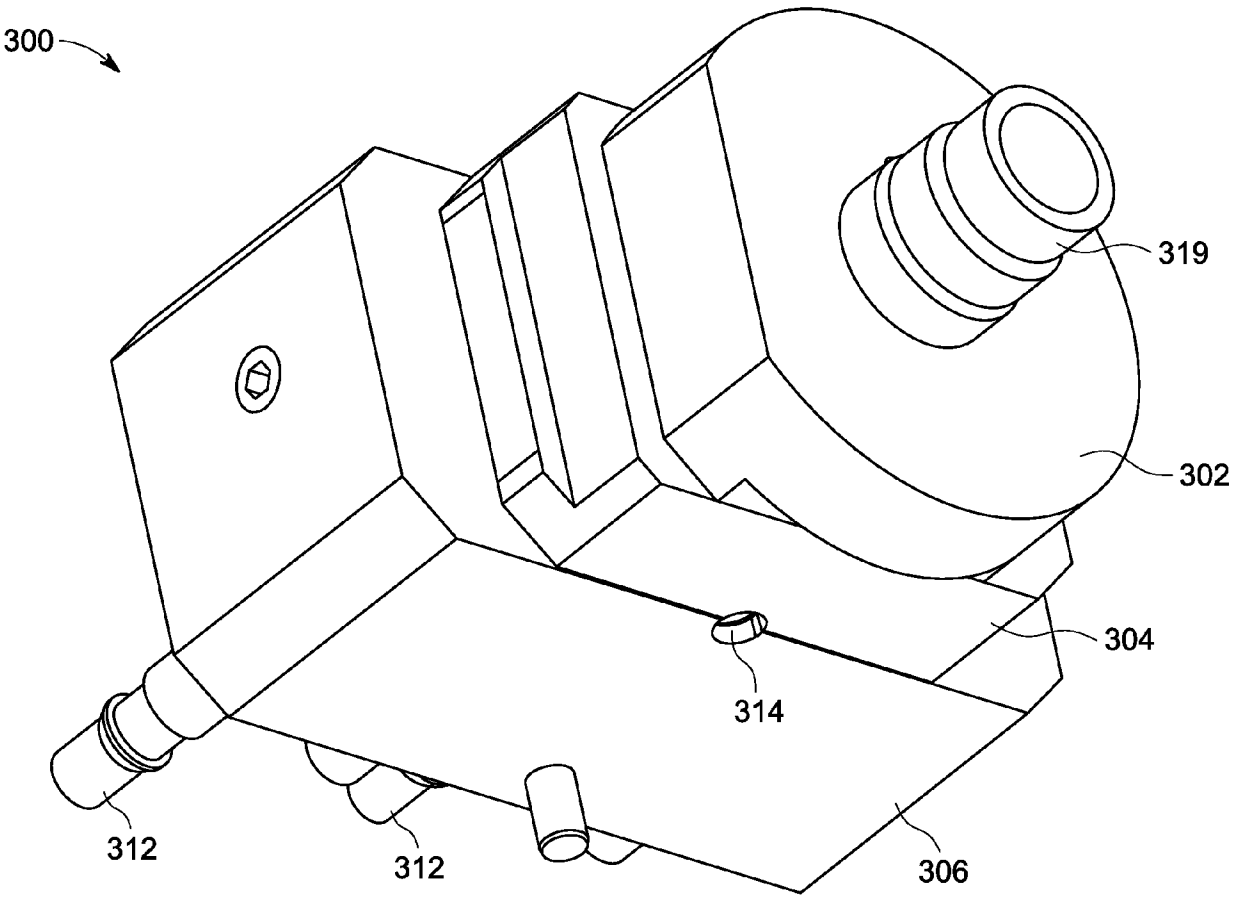
FIG. 3 is another perspective view of the target body of FIG. 2.

The foregoing summary, as well as the following detailed description of certain embodiments will be better understood when read in conjunction with the appended drawings. To the extent that the figures illustrate diagrams of the blocks of various embodiments, the blocks are not necessarily indicative of the division between hardware. Thus, for example, one or more of the blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments provide a self-shielded target system for isotope production systems using higher density materials for forming portions of the target systems, particularly, portions that encase components that are susceptible to high radioactive activation. The higher density material provides higher gamma radiation attenuation to reduce the level of gamma radiation exposure, such as to personnel. In various embodiments, supporting structures (e.g., a portion of a housing) around activated parts (e.g. highly activated parts) are constructed from high density/high attenuation materials such that the radiation levels/dose rates outside the target system are reduced. Thus, an active shield for a target system for isotope production systems is provided. The activated parts of the target system are shielded not only during operation, but also when transporting, maintaining and storing the target system.

A self-shielded target system formed in accordance with various embodiments may be used in different types and configurations of isotope production systems. For example, FIG. 1 is a block diagram of an isotope production system 100 formed in accordance with various embodiments in which a self-shielded target system may be provided. The system 100 includes a cyclotron 102 having several subsystems including an ion source system 104, an electrical field system 106, a magnetic field system 108, and a vacuum system 110. During use of the cyclotron 102, charged particles are placed within or injected into the cyclotron 102 through the ion source system 104. The magnetic field system 108 and electrical field system 106 generate respective fields that cooperate with one another in producing a particle beam 112 of the charged particles.

Also shown in FIG. 1, the system 100 has an extraction system 115 and a target system 114 that includes a target material 116. The target system 114 may be positioned adjacent to the cyclotron 102 and is self-shielded as described in more detail herein. To generate isotopes, the particle beam 112 is directed by the cyclotron 102 through the extraction system 115 along a beam transport path or beam passage 117 and into the target system 114 so that the particle beam 112 is incident upon the target material 116 located at a corresponding target location 120. When the target material 116 is irradiated with the particle beam 112, radiation from neutrons and gamma rays may be generated, which can activate portions of the target system 114, such as foil portions of the target system 114.

It should be noted that in some embodiments the cyclotron 102 and target system 114 are not separated by a space or gap (e.g., separated by a distance) and/or are not separate parts. Accordingly, in these embodiments, the cyclotron 102 and target system 114 may form a single component or part such that the beam passage 117 between components or parts is not provided.

The system 100 may have multiple target locations 120A-C where separate target materials 116A-C are located. A shifting device or system (not shown) may be used to shift the target locations 120A-C with respect to the particle beam 112 so that the particle beam 112 is incident upon a different target material 116. A vacuum may be maintained during the shifting process as well. Alternatively, the cyclotron 102 and the extraction system 115 may not direct the particle beam 112 along only one path, but may direct the particle beam 112 along a unique path for each different target location 120A-C. Furthermore, the beam passage 117 may be substantially linear from the cyclotron 102 to the target location 120 or, alternatively, the beam passage 117 may curve or turn at one or more points therealong. For example, magnets positioned alongside the beam passage 117 may be configured to redirect the particle beam 112 along a different path.

Examples of isotope production systems and/or cyclotrons having one or more of the sub-systems are described in U.S. Pat. Nos. 6,392,246; 6,417,634; 6,433,495; and 7,122,966 and in U.S. Patent Application Publication No. 2005/0283199. Additional examples are also provided in U.S. Pat. Nos. 5,521,469; 6,057,655; 7,466,085; and 7,476,883. Furthermore, isotope production systems and/or cyclotrons that may be used with embodiments described herein are also described in copending U.S. patent application Ser. Nos. 12/492,200; 12/435,903; 12/435,949; and 12/435,931.

The system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. By way of example, the system 100 may generate protons to make different isotopes. Additionally, the system 100 may also generate protons or deuterons in order to produce, for example, different gases or labeled water.

In some embodiments, the system 100 uses $^{1}H^{-}$ technology and brings the charged particles to a low energy (e.g., about 8 MeV) with a beam current of approximately 10-30 μA. In such embodiments, the negative hydrogen ions are accelerated and guided through the cyclotron 102 and into the extraction system 115. The negative hydrogen ions may then hit a stripping foil (not shown in FIG. 1) of the extraction system 115 thereby removing the pair of electrons and making the particle a positive ion, $^{1}H^{+}$. However, in alternative embodiments, the charged particles may be positive ions, such as $^{1}H^{+}$, $^{2}H^{+}$, and $^{3}He^{+}$. In such alternative embodiments, the extraction system 115 may include an electrostatic deflector that creates an electric field that guides the particle beam toward the target material 116. It should be noted that the various embodiments are not limited to use in lower energy systems, but may be used in higher energy systems, for example, up to 25 MeV and higher beam currents.

The system 100 may include a cooling system 122 that transports a cooling or working fluid to various components of the different systems in order to absorb heat generated by the respective components. The system 100 may also include a control system 118 that may be used by a technician to control the operation of the various systems and components. The control system 118 may include one or more user-interfaces that are located proximate to or remotely from the cyclotron 102 and the target system 114. Although not shown in FIG. 1, the system 100 may also include one or more radiation and/or magnetic shields for the cyclotron 102 and the target system 114, as described in more detail below.

The system 100 may produce the isotopes in predetermined amounts or batches, such as individual doses for use in medical imaging or therapy. Accordingly, isotopes having different levels of activity may be provided.

The system 100 may be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. In particular embodiments, the system 100 accelerates the charged particles to an energy of approximately 9.6 MeV or less. In more particular embodiments, the system 100 accelerates the charged particles to an energy of approximately 8 MeV or less. Other embodiments accelerate the charged particles to an energy of approximately 18 MeV or more, for example, 20 MeV or 25 MeV.

The target system 114 includes a self-shielded target having a self-shielded target body 300 as illustrated in FIGS. 2 through 5. The self-shielded target body 300 shown assembled in FIGS. 2 and 3 (and in exploded view in FIGS. 4 and 5) is formed from three components defining an outer structure of the self-shielded target body 300. In particular, the outer structure of the self-shielded target body 300 is formed from a housing portion 302 (e.g., a front housing portion or flange), a housing portion 304 (e.g., cooling housing portion or flange) and housing portion 306 (e.g., a rear housing portion or flange assembly). The housing portions 302, 304 and 306 may be, for example, sub-assemblies secured together using any suitable fastener, illustrated as a plurality of screws 308 each having a corresponding washer 310. The housing portions 302 and 306 may be end housing portions with the housing portion 304 being an intermediate housing portion. The housing portions 302, 304 and 306 form a sealed target body 300 having a plurality of ports 312 on a front surface of the housing portion 306, which in the illustrated embodiment operate as helium and water inlets and outlets that may be connected to helium and water supplies (not shown). Additionally, additional ports or openings 314 may be provided on top and bottom portions of the target body 300. The openings 314 may be provided for receiving fittings or other portions of a port therein.

Figure 4:
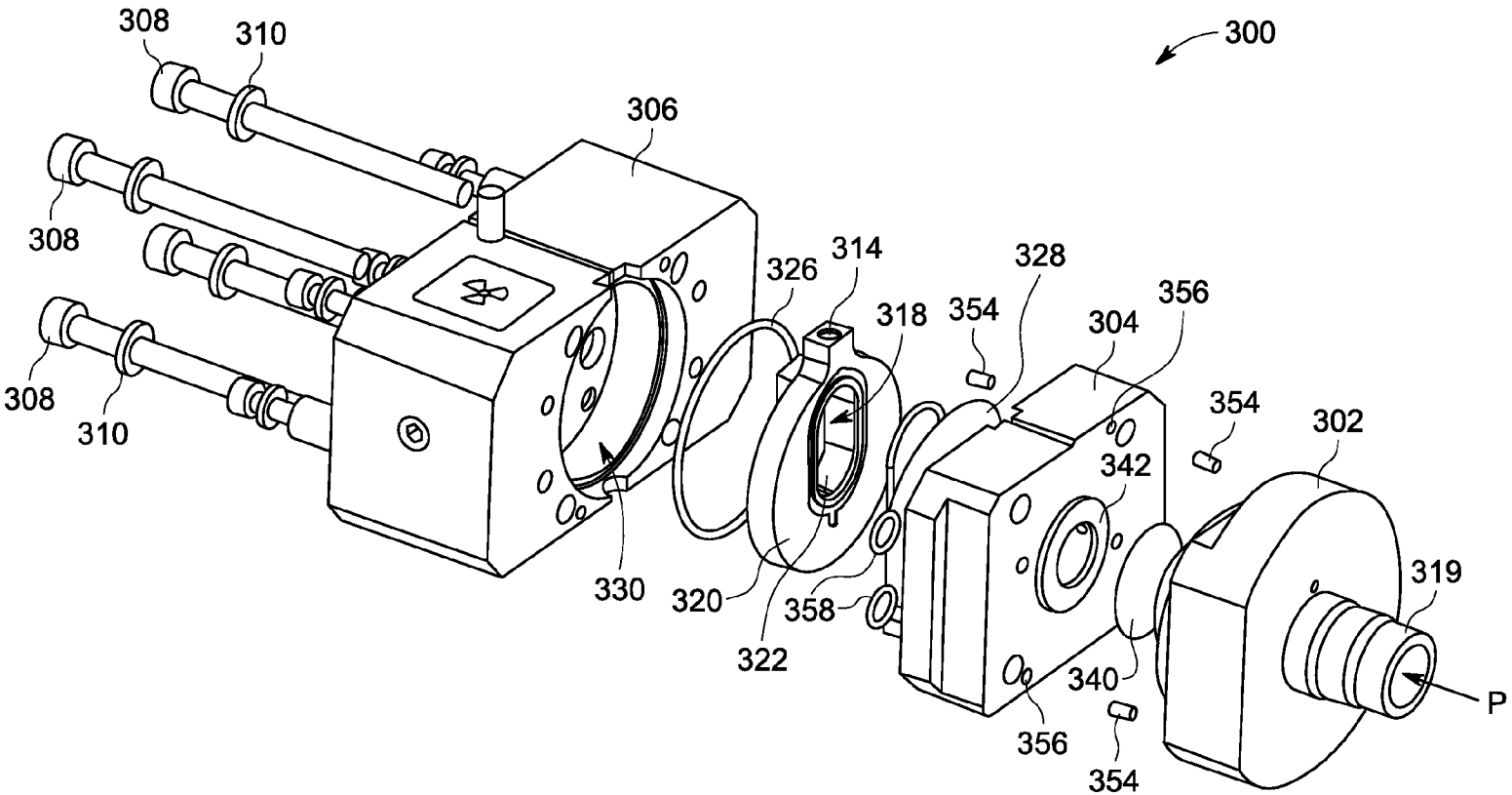
FIG. 4 is an exploded view of the target body of FIG. 2 showing components therein.
Figure 5:
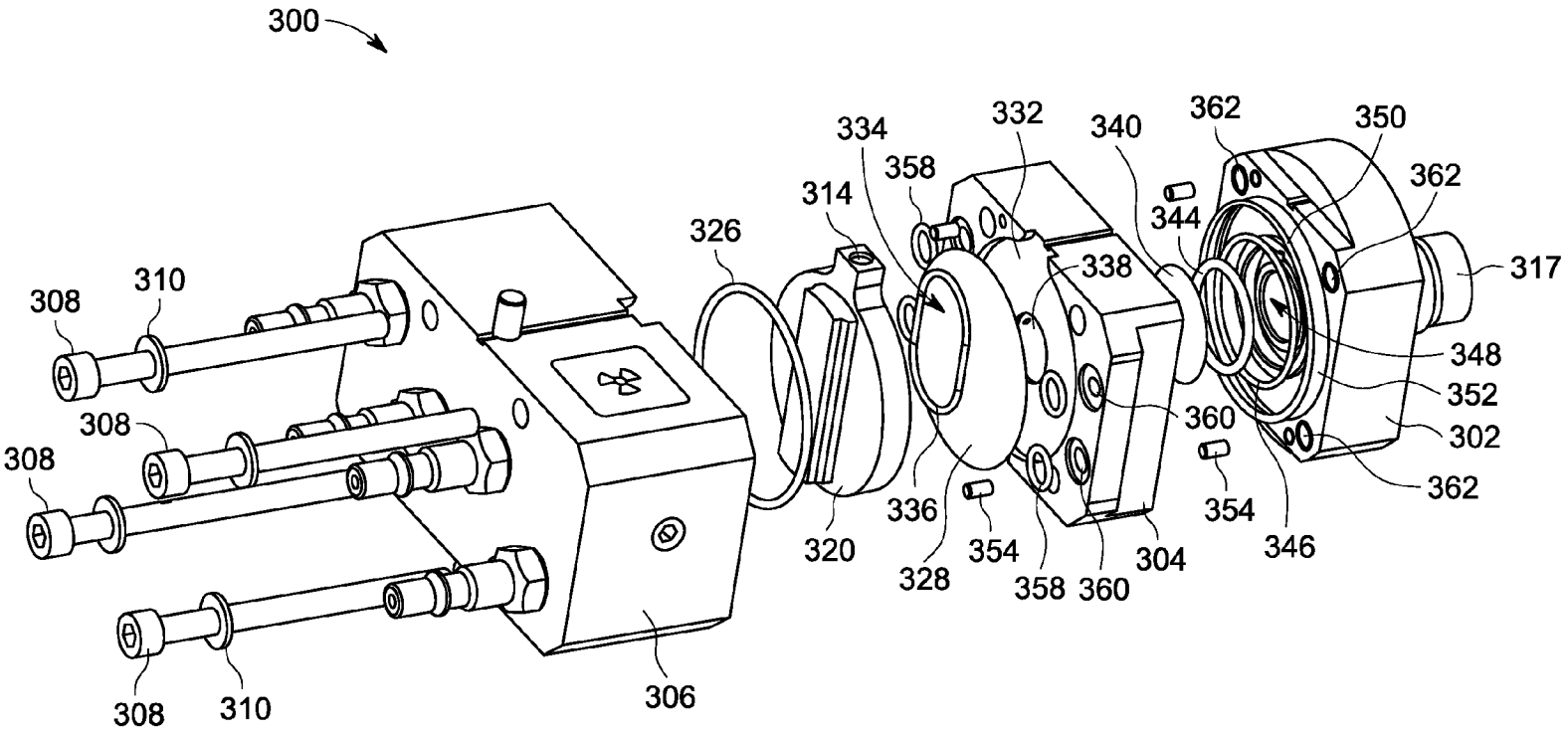
FIG. 5 is another exploded view of the target body of FIG. 2 showing components therein.

As described below, a passageway for the charged particle is provided within the target body 300, for example, a path for a proton beam that may enter the target body as illustrated by the arrow P in FIG. 4. The charged particles travel through the target body 300 from a tubular opening 319, which acts as a particle path entrance, to a cavity 318 (shown in FIG. 6) that is a final destination of the changed particles. The cavity 318 in various embodiments is water filled, for example, with about 2.5 milliliters (ml) of water, thereby providing a location for irradiated water ($H_2{}^{18}O$). The cavity 318 is defined within a body 320 formed, for example, from a Niobium material having a cavity 322 with an opening on one face. The body 320 includes the top and bottom openings 314 for receiving therein fittings, for example.

It should be noted that the cavity 318, in various embodiments, is filled with different liquids or with gas. In still other embodiments, the cavity 318 may be filled with a solid target, wherein the irradiated material is, for example, a solid, plated body of suitable material for the production of certain isotopes.

The body 320 is aligned between the housing portion 306 and the housing portion 304 between a sealing ring 326 (e.g., an O-ring) adjacent the housing portion 306 and a foil member 328, such as a metallic foil member, for example, an alloy disc formed from a heat treatable cobalt base alloy, such as Havar, adjacent the housing portion 304. It should be noted that the housing portion 306 also includes a cavity 330 shaped and sized to receive therein the sealing ring 326 and a portion of the body 320. Additionally, the housing portion 306 includes a cavity 332 sized and shaped to receive therein a portion of the foil member 328. The foil member 328 may include a sealing border 336 (e.g., a Helicoflex border) configured to fit within the cavity 322 of the body 320, and the foil member 328 is also aligned with an opening 338 to a passage through the housing portion 304.

Another foil member 340 optionally may be provided between the housing portion 304 and the housing portion 302. The foil member 340 similarly may be an alloy disc similar to the foil member 328. The foil member 340 aligns with the opening 338 of the housing portion 304 having an annular rim 342 there around. A seal 344, a sealing ring 346 aligned with an opening 348 of the housing portion 302 and a sealing ring 350 fitting onto a rim 352 of the housing portion 302 are provided between the foil member 340 and the housing portion 302. It should be noted that more or less foil members, such as foil members may be provided. For example, in some embodiments only the foil member 328 is included and the foil member 340 is not included. Accordingly, single foil member or multi-foil member arrangements are contemplated by the various embodiments.

It should be noted that the foil members 328 and 340 are not limited to a disc or circular shape and may be provided in different shapes, configurations and arrangements. For example, the one or more the foil members 328 and 340, or additional foil members, may be square shaped, rectangular shaped, or oval shaped, among others. Also, it should be noted that the foil members 328 and 340 are not limited to being formed from a particular material, but in various embodiments are formed from a an activating material, such as a moderately or high activating material that can have radioactivity induced therein as described in more detail herein. In some embodiments, the foil members 328 and 340 are metallic and formed from one or more metals.

As can be seen, a plurality of pins 354 are received within openings 356 in each of the housing portions 302, 304 and 306 to align these component when the target body 300 is assembled. Additionally, a plurality of sealing rings 358 align with openings 360 of the housing portion 304 for receiving therethrough the screws 308 that secure within bores 362 (e.g., threaded bores) of the housing portion 302.

During operation, as the proton beam passes through the target body 300 from the housing portion 302 into the cavity 318, the foil members 328 and 340 may be heavily activated (e.g., radioactivity induced therein). In particular, the foil members 328 and 340, which may be, for example, thin (e.g., 5-50 micrometer or micron (μm)) foil alloy discs, isolate the vacuum inside the accelerator, and in particular the accelerator chamber and from the water in the cavity 322. The foil members 328 and 340 also allow cooling helium to pass therethrough and/or between the foil members 328 and 340. It should be noted that the foil members 328 and 340 having a thickness that allows a proton beam to pass therethrough, which results in the foil members 328 and 340 becoming highly radiated and which remain activated.

Some embodiments provide self-shielding of the target body 300 that actively shields the target body 300 to shield and/or prevent radiation from the activated foil members 328 and 340 from leaving the target body 300. Thus, the foil members 328 and 340 are encapsulated by an active radiation shield. Specifically, at least one of, and in some embodiments, all of the housing portions 302, 304 and 306 are formed from a material that attenuates the radiation within the target body 300, and in particular, from the foil members 328 and 340. It should be noted that the housing portions 302, 304 and 306 may be formed from the same materials, different materials or different quantities or combinations of the same or different materials. For example, housing portions 302 and 304 may be formed from the same material, such as aluminum, and the housing portion 306 may be formed from a combination or aluminum and tungsten.

In various embodiments, one or more of the housing portion 302, housing portion 304 and/or housing portion 306, or parts thereof, are formed from a material having a density higher or greater than aluminum. In some embodiments, the material forming at least one of the housing portion 302, housing portion 304 and/or housing portion 306 has a density value greater than that of aluminum, which has a density near room temperature of 2.70 g/cm$^3$. For example, one or more of the housing portion 302, housing portion 304 and/or housing portion 306 may be formed from material(s), such as a metal or alloy having a density greater than aluminum, such as a density value of about 5 g/cm$^3$. In other embodiments, one or more of the housing portion 302, housing portion 304 and/or housing portion 306 may be formed from material(s), such as a metal or alloy having a density value greater than 5 g/cm$^3$, for example, a density value of about 10 g/cm$^3$. In these embodiments, for example, the material generally has a density value greater than that of steel (having a density near room temperature of about 8 g/cm$^3$). In other embodiments, the density value is greater than, for example, 10 g/cm$^3$, However, it should be noted that other materials or alloys may be used having greater or lesser density values, such as tungsten (having a density near room temperature of 19.25 g/cm$^3$) or tungsten alloys having a lower density value than tungsten alone. For example, in some embodiments, the tungsten alloy has a density value less than 19.25 g/cm$^3$ and includes other metals, such as nickel, copper or iron, among others. In other embodiments, for example, a lead alloy may be used. It also should be noted that when reference is made herein to a particular density value or being greater than a particular density value, in some embodiments, the density value may also be equal to or slightly less than that particular density value.

Thus, in various embodiments, one or more of the housing portion 302, housing portion 304 and/or housing portion 306, or parts thereof, are formed from one or more materials, that may include aluminum, and having a higher density value than aluminum. For example, an alloy containing tungsten and a combination of one or more of magnesium, copper and/or iron may be provided in some embodiments.

The housing portion 302, housing portion 304 and/or housing portion 306 are formed such that a thickness of each, particularly between the foil members 328 and 340 and the outside of the target body 300 provides shielding to reduce radiation emitted therefrom. It should be noted that the housing portion 302, housing portion 304 and/or housing portion 306 may be formed from any material having a density value greater than that of aluminum. Also, each of the housing portion 302, housing portion 304 and/or housing portion 306 may be formed from different materials or combinations or materials as described in more detail herein.

Thus, at least one of the housing portion 302, housing portion 304 and housing portion 306 or portions thereof encompass or surround the foil members 328 and 340 to provide shielding, such as when radioactivity is induced in the foil members 328 and 340. For example, recesses within any one of the housing portion 302, housing portion 304 and housing portion 306 may receive therein a portion of the one of the foil members 328 and 340.

Figure 6:
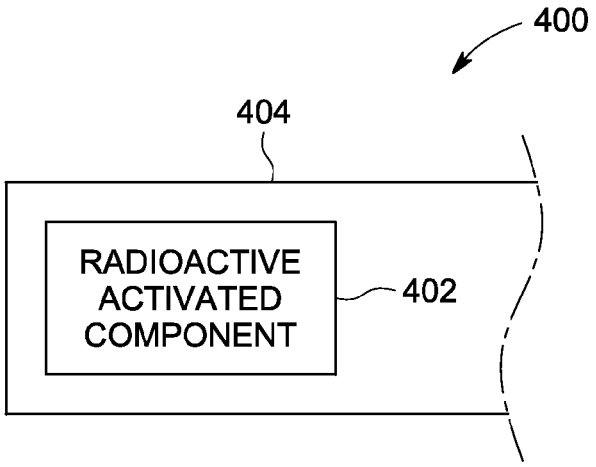
FIG. 6 is a simplified block diagram of a self-shielded target arrangement formed in accordance with various embodiments.

It should be noted that the target body 300 may be provided in different configurations and is not limited to the components and arrangements shown in FIGS. 2 through 5. Accordingly, the various embodiments may be implemented in connection with any type or configuration of target by forming one or more of the housing portions or components from a higher density material, particularly of a higher density than aluminum to shield the outside of the target from radiation, such as from an activated component within the target body. Thus, as shown in FIG. 6, the various embodiments may be implemented in connection with a target 400 wherein a radioactive activated component 402 (e.g., a component susceptible to being radioactively induced), such as a component that may be heavily activated by radiation during operation of an isotope production system, is shielded within a casing 404 (or a portion thereof) formed from a material having a higher density value, for example, a density value greater than aluminum. The casing 404 may form a portion of a target housing.

Figure 7:
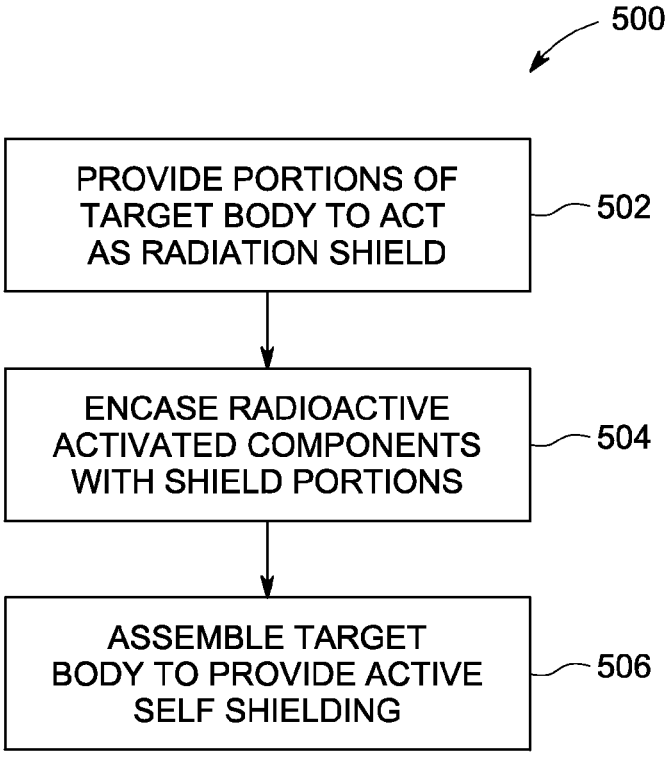
FIG. 7 is a flowchart of method for providing a self-shielded target for an isotope production system in accordance with various embodiments.

Various embodiments also include a method 500 as shown in FIG. 7 for providing self-shielded target for an isotope production system. The method includes providing one or more portions of the target body at 502 to act as a radiation shield. The portions of the target body may be formed from any suitable type of radiation shielding material, such as a material having a density greater than aluminum as described in more detail herein. Thereafter, the radioactive activated components, for example, foil members that are activated during the operation of the isotope production system are encased by the shielded portions at 504. For example, portions of the target body that include the radioactive activated components are aligned with the shielded portions. It should be noted that as used herein, radioactive activated components generally refer to components that may be activated by radiation or wherein radioactivity may be induced in the component.

The target body is then assembled at 506 such that an active self-shielding target system is provided. The active shielding provides gamma radiation attenuation during operation of the isotope production system, as well as during maintenance, transportation and storage of the target.

Embodiments described herein are not intended to be limited to generating radioisotopes for medical uses, but may also generate other isotopes and use other target materials. Also the various embodiments may be implemented in connection with different kinds of cyclotrons having different orientations (e.g., vertically or horizontally oriented), as well as different accelerators, such as linear accelerators or laser induced accelerators instead of spiral accelerators. Furthermore, embodiments described herein include methods of manufacturing the isotope production systems, target systems, and cyclotrons as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the various embodiments, the various embodiments are by no means limiting and are exemplary embodiments. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments, including the best mode, and also to enable any person skilled in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A target for an isotope production system, the target comprising:

a housing having a passageway therethrough for a charged particle beam, the housing including a shielding portion formed from a material having a density value greater than a density value of aluminum, the housing including an additional portion sealingly joined to the shielding portion along a length of the passageway;

a chamber within the shielding portion of the housing, the chamber positioned such that at least a portion of the passageway extends therethrough; and a body loaded into the chamber and interposed between the shielding portion and the additional portion, the body including a cavity configured to hold a target material, the body positioned in the passageway such that the cavity of the body receives charged particles from the charged particle beam as the beam passes through the passageway.

2. The target in accordance with claim 1 wherein the shielding portion is formed from the material having the density value greater than the density value of aluminum, and the additional portion is not formed from the material having the density value greater than the density value of aluminum.

3. The target in accordance with claim 1 further comprising at least one foil member interposed between the body and one of the shielding portion or the additional portion.

4. The target in accordance with claim 3 wherein the at least one foil member is formed from an activating material wherein radioactivity may be induced therein by the charged particle beam.

5. The target in accordance with claim 1 wherein the shielding portion comprises a material having a density value greater than 5 g/cm$^3$.

6. The target in accordance with claim 1 wherein the shielding portion comprises a material having a density value greater than 10 g/cm$^3$.

7. The target in accordance with claim 1 wherein the shielding portion comprises a tungsten material.

8. The target in accordance with claim 1 wherein the shielding portion comprises a tungsten alloy material.

9. The target in accordance with claim 1 further comprising a target material within the housing and wherein the charged particle beam is configured to form a Positron Emission Tomography (PET) radioisotope from the target material.

10. The target in accordance with claim 1 wherein the additional portion comprises an aluminum material.

11. The target in accordance with claim 1 wherein the shielding portion comprises a tungsten-copper material.

12. The target in accordance with claim 1 wherein the shielding portion is positioned adjacent the component.

13. The target in accordance with claim 1 wherein the housing comprises a plurality of housing portions including the shielding portion, a front flange and a rear flange, one of the front flange or the rear flange comprising the additional portion, the shielding portion positioned between the front and rear flanges, each of the shielding portion, front flange, and rear flange having faces abutting against each other with the chamber open in one face of the shielding portion, with a face of the additional portion cooperating with the shielding portion to sealingly close the chamber, the rear flange having one or more cooling ports on a face thereof and a target material therein positioned in the passageway, the rear flange formed from the material having the density value greater than the density value of aluminum.

14. The target in accordance with claim 13 wherein the front flange is formed from aluminum, the front flange including a tubular opening on one of the faces through which the charged particle beam enters the housing.

15. The target in accordance with claim 13 wherein the rear flange comprises the additional member and has a chamber, wherein the portion of the body extends into the chamber of the rear flange.

16. The target in accordance with claim 1 wherein the shielding portion has a recess therein that is sized and shaped to receive therein at least a portion of the component.

17. The target in accordance with claim 16 wherein the shielding portion comprises a face with the recess therein and the housing comprises a plurality of housing portions, the component extending beyond the face of the shielding portion to one of the other housing portions.

18. The target in accordance with claim 1 wherein the shielding portion is formed from a combination of aluminum and tungsten.

* * * * *